US006520787B1

(12) United States Patent
Lott

(10) Patent No.: US 6,520,787 B1
(45) Date of Patent: Feb. 18, 2003

(54) MULTIPLE PLUG FOR DIFFERENT CONNECTION SYSTEMS

(76) Inventor: Oswald Lott, In der Aue 8-10, D063584 Gründau (DE)

( * ) Notice: Subject to any disclaimer, the term of this patent is extended or adjusted under 35 U.S.C. 154(b) by 0 days.

(21) Appl. No.: 09/646,382

(22) PCT Filed: Mar. 17, 1999

(86) PCT No.: PCT/EP99/01731

§ 371 (c)(1),
(2), (4) Date: Dec. 19, 2000

(87) PCT Pub. No.: WO99/48174

PCT Pub. Date: Sep. 23, 1999

(30) Foreign Application Priority Data

| | | |
|---|---|---|
| Mar. 17, 1998 | (DE) | 198 11 465 |
| Aug. 4, 1998 | (DE) | 198 35 161 |
| Sep. 22, 1998 | (DE) | 298 16 948 U |
| Feb. 24, 1999 | (DE) | 299 03 331 U |

(51) Int. Cl.[7] ..... H01R 27/00

(52) U.S. Cl. ..... 439/218; 439/53; 439/166; 439/171

(58) Field of Search ..... 439/218, 166, 439/170, 171, 172, 173, 174, 175, 52, 53, 652, 460

(56) References Cited

U.S. PATENT DOCUMENTS

| | | | | |
|---|---|---|---|---|
| 4,856,999 A | * | 8/1989 | Flohr | 439/52 |
| 5,468,912 A | * | 11/1995 | Zalewski | 174/86 |
| 5,695,365 A | * | 12/1997 | Kennedy et al. | 439/638 |
| 5,850,123 A | * | 12/1998 | Chou | 439/172 |
| 6,179,646 B1 | * | 1/2001 | Horchler | 439/460 |

* cited by examiner

*Primary Examiner*—Tho D. Ta
*Assistant Examiner*—Ross Gushi
(74) *Attorney, Agent, or Firm*—Leydig, Voit & Mayer, Ltd.

(57) ABSTRACT

The invention relates to a multi-pole multiple plug for connecting (small) electric appliances to a selection of different mains connection systems. The plug has internationally standardized pin arrangements (2) an the four sides of its housing (1) and an the base of the housing (1) is fitted with a recess for adjustably housing a contact tube (4–7) situated at the free end of a connecting cable (3) so that the strands of the connecting cable (4–7) can be connected inside the housing (1) With the pin arrangement (2) required at any particular time.

8 Claims, 10 Drawing Sheets

Fig. 8
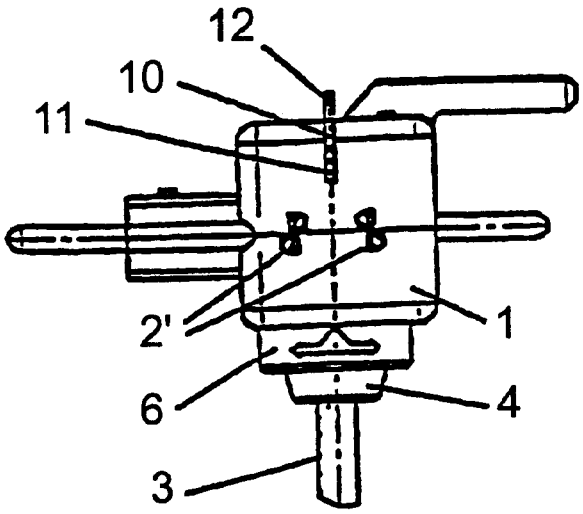
Fig. 9
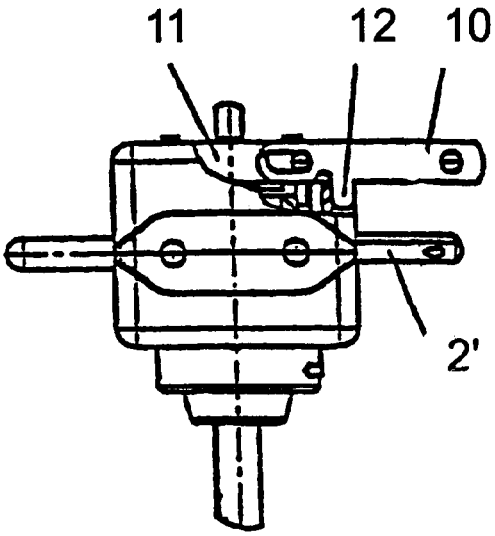
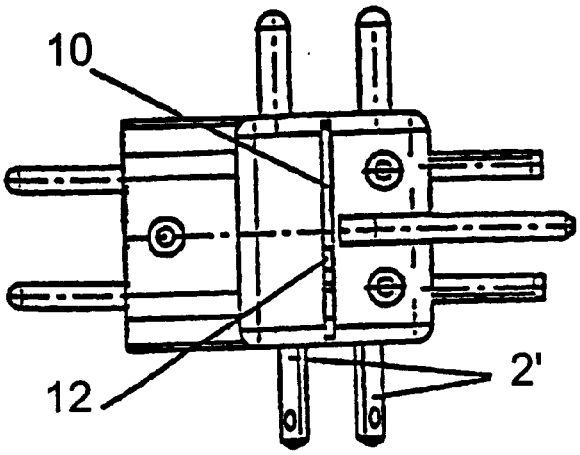
Fig. 10
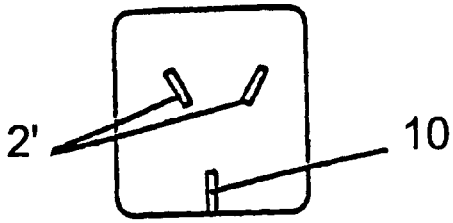
Fig. 7

Fig. 18
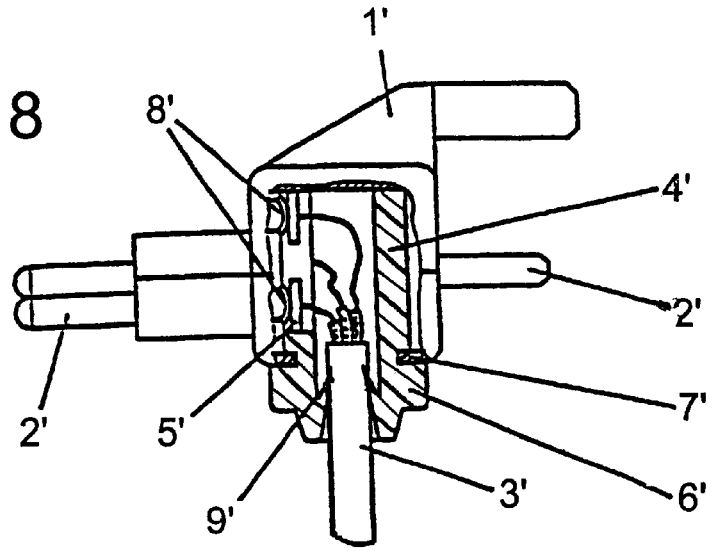
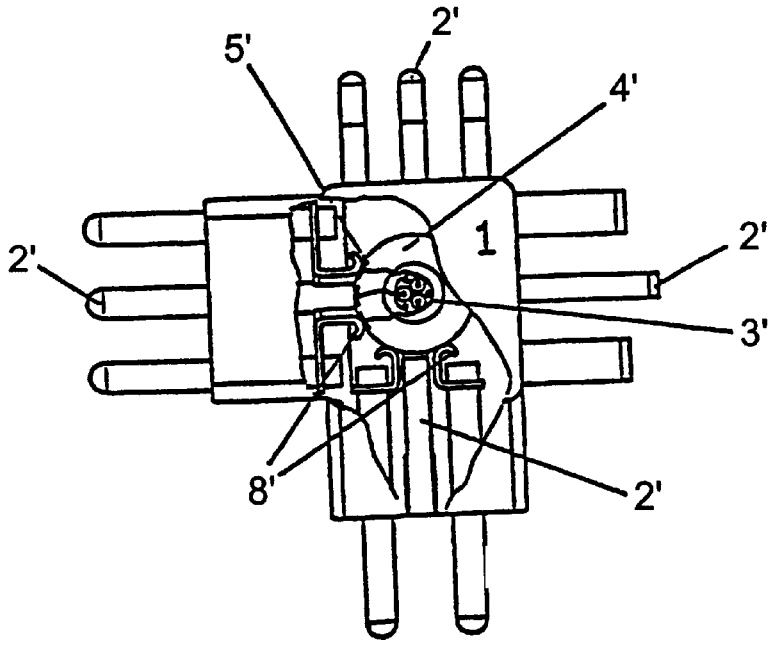
Fig. 19
Fig. 20
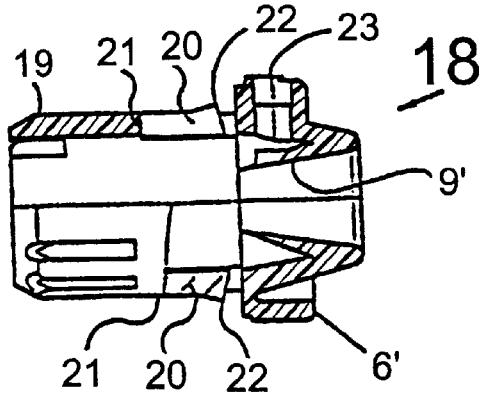

MULTIPLE PLUG FOR DIFFERENT CONNECTION SYSTEMS

FIELD OF THE INVENTION

The invention relates to a multiple plug for a multipole, especially two-pole or three-pole, connection of electric devices, especially small devices such as computer and telecommunication equipment, electric shaving devices or hair driers, to internally different electrical outlet systems.

BACKGROUND OF THE INVENTION

For connecting electrical devices to the different electrical outlet systems found throughout the world, travel plug sets are known which consist of several adapter plugs, each of which is configured to adapt a given plug system to different outlet systems. In the face of this, it was attempted to make an intermediate plug that was alternatively usable for several different plug systems with the aid of slide mechanics and by the turning-out of individual plug pins (see, e.g., DE 297 01 285 U1). This device, however, is neither properly nor safely handled by a non-electrician, even with the aid of the operating instructions.

In view of this, there has come into practice the use of special plug adapters which allow electrical devices equipped with the plug configuration used in a given country to be used in the manner of a combined intermediate plug also in the plug outlets present in other countries and parts of the world.

Such a multiple plug adapter is described in DE 36 01 469 A1. This reference describes a connecting piece which, in the form of a penta-prism, has on its side surfaces the plug pin arrangements of different plugging systems and internally supports a rotary body which contains in the area of the cover and/or base surface of the connecting piece plug outlets for further plugging systems. This device can be manually adjusted with for the particular required plug pin arrangement of the plug body with the remaining plug pins standing free.

Because such adapters are a separate and independent component from the electrical device they always have the disadvantage of being easily misplaced or even of getting lost. In addition, there are the disadvantages of size and scope of such traveling adapters as well as their cost.

SUMMARY OF THE INVENTION

In view of this, underlying the present invention is the problem of designing a usable plug directly on the power cord of an electrical device so that the electrical device can be plugged at will into the outlets of several differently configured electrical outlet systems without the need for additional intermediate connecting elements.

The problem is solved according to the present invention by a multiple plug comprising a block shaped housing having a first side surface from which extends various standardized plug pin arrangements for different plug systems and a second side surface which has a recess into which a contact carrier is adjustably supported. The contact carrier is firmly secured to the free end of the connecting cable. The contacts of the contact carrier are connected with the electrical strands of the connecting cable. The plug pins associated with the different plug systems are selectively connectable with the contacts of the contact carrier via mating counter contacts provided on the plug pins. By moving the housing relative to the contact carrier, the plug pins of one of the given standardized pin arrangements can be brought into conducting engagement with the contacts of the contact carrier to thereby allow the electrical device to be used in that type of plug and outlet electrical connection system. Thus, the electrical device can be adjusted for use in different plug and outlet systems simply by aligning the contacts on the contact sleeve with the desired standardized plug pin arrangement.

These and other features and advantages of the present invention will be more readily apparent upon reading the following description of exemplary embodiments of the invention and upon reference to the accompanying drawings wherein:

BRIEF DESCRIPTION OF THE DRAWINGS

FIG. 7 is a schematic drawing of a plug pin arrangement according to the Australian standard, FIGS. 8 and 9 are side views of a multiple plug similar to that of FIG. 1 which has been modified to accommodate a pin arrangement according to the Australian standard, FIG. 10 is a plan view of the upper surface of the housing of the multiple plug of FIGS. 8 and 9, FIGS. 11–13 are enlarged partial side views of the multiple plug of FIGS. 8 and 9 showing the releasing contact moving between a rest position and an operating position, FIG. 18 is a partially sectioned side view of the multiple plug of FIGS. 14 and 15, FIG. 19 is a partially sectioned side view of the base surface of the multiple plug of FIGS. 14 and 15, FIG. 20 is a partially sectioned side view of a further embodiment of a contact sleeve.

DETAILED DESCRIPTION OF THE INVENTION

Figure 1:
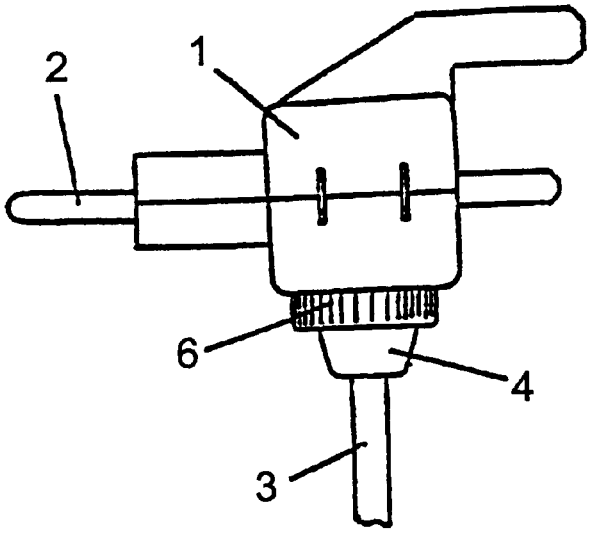
FIG. 1 is a side view of an illustrative multiple plug according to the present invention having different standardized pin arrangements.

As is evident from the drawings, the plug housing 1 of insulating material has on its side surface the plug pin arrangements of four different internationally standardized electrical connecting systems. In the interest of clarity, only the pins of the European configured plug, to the left in FIGS. 1, 3, 5 and 6, are provided with the reference number 2. For adjustably supporting the connecting cable 3 in the plug housing 1, a contact sleeve 4 is provided on the cable end which is separately shown in FIG. 4. The contact sleeve 4 is, in turn, supported in a recess in the plug housing in such a manner that the position of the contact sleeve 4 can be adjusted relative to the plug housing 1.

The contact sleeve 4 consists of a plastic hollow cylinder into which the connecting cable 3 is inserted. The electrical strands of the connecting cable are connected with contact paths 5 (see FIGS. 4 and 5), which are present on the outer circumference of the hollow cylinder of the contact sleeve 4. The connecting cable 3 is acted upon in its sheath by a plurality of barbs 9 (FIG. 5) that are arranged in the contact sleeve and surround the connecting cable and extend in the insertion direction. In the event of a tension stress on the connecting cable 3, the barbs 9 can penetrate into the sheathing by means of their acutely converging ends and thus prevent the cable from pulling out of the contact sleeve 4.

Figure 5:
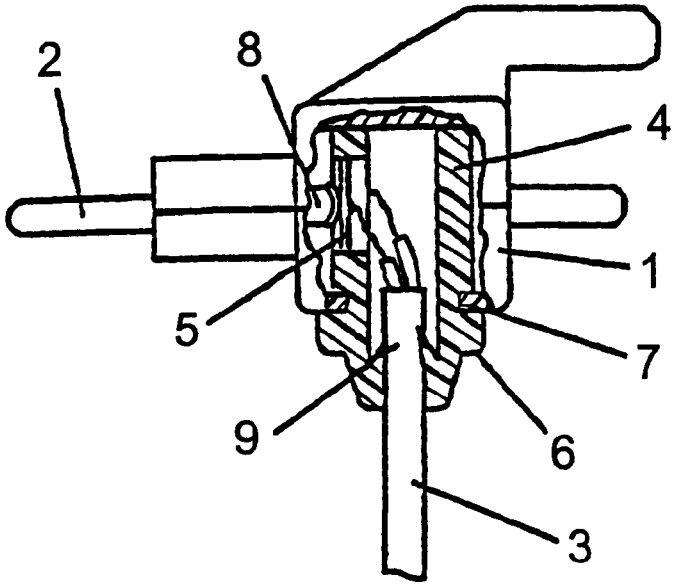
FIG. 5 is a partially sectioned side view of the multiple plug of FIG. 1.
Figure 6:
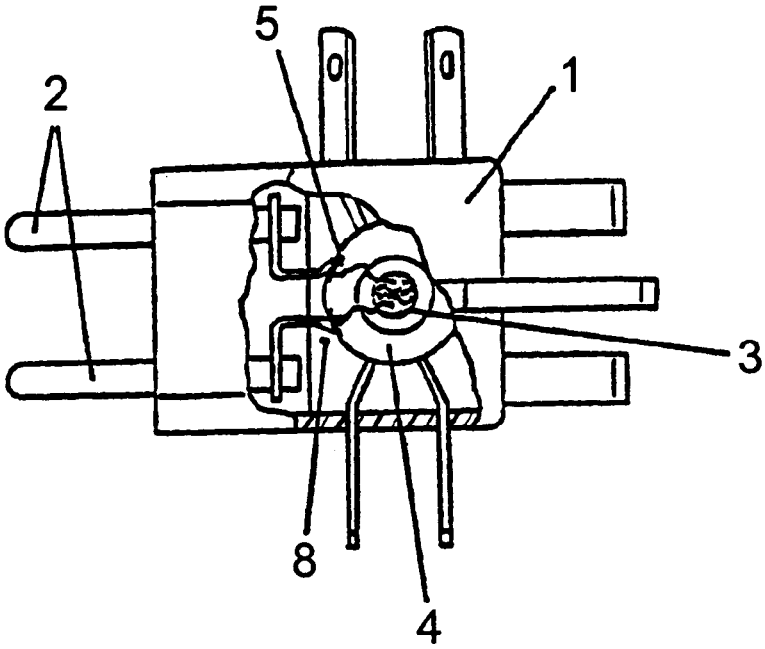
FIG. 6 is a partially sectioned plan view of the base surface of the multiple plug of FIG. 1.

Further, the contact sleeve 4 is provided in the axial direction, after the contact paths 5 and before a knurled flange 6, with an annular groove 7 that facilitates adjustment of the position of the contact sleeve relative to the housing. A guide lip which extends from the side of the recess opening in the plug housing I extends into the annular groove 7 when the contact sleeve is assembled into the plug housing as shown in FIG. 5. It is possible to install a conventional locking mechanism or device between the plug housing 1 and the knurled flange 6 which would facilitate precise manual adjustment of the contact sleeve 4 into, in this case, the four use positions that are offset to one another by 90°.

The adjustability of the contact sleeve 4 relative to the plug housing 1 allows the two contact paths 5 on the contact sleeve to be selectively brought into engagement with mating contact sets 8 which extend from the connecting ends of the different plug pins. The mating contact sets (FIGS. 5 and 6) are resilient and extend in the correct pole orientation from the connecting ends of the different plug pins 2 into the recess of the plug housing where the contact sleeve 4 is adjustably supported.

In this manner, before use, it is possible to adjust the proposed multiple plug simply by hand by first rotating the guiding cable in the direction of the required plugging system and securing the respective plugging pins for that system into the plugging outlet. After this, the required change of the electrical device to that plugging system can be brought about just as simply and safely by merely turning the knurled flange 6 on the contact sleeve 4 so as to move the contact paths 5 on the sleeve 4 into conductive engagement with the mating contact set 8 associated with the plugging pins of the appropriate plugging system.

Figure 2:
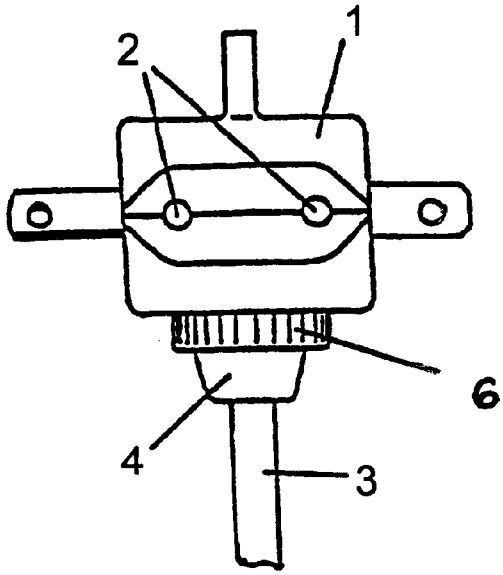
FIG. 2 is another side view of the multiple plug of FIG. 1.
Figure 3:
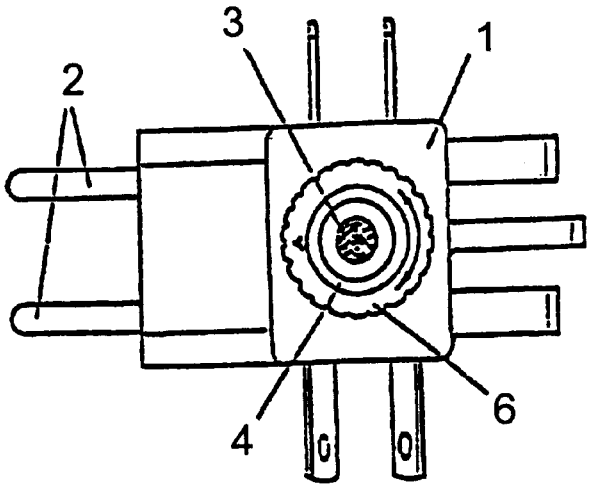
FIG. 3 is a bottom view of the base surface of the multiple plug of FIG. 1.
Figure 4:
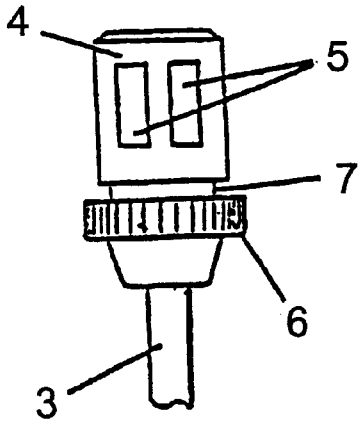
FIG. 4 is a side view of a contact sleeve of the multiple plug of FIG. 1.

For establishing a connection with a plug outlet according to the Australian standard there is taken into account the peculiarity that the plug pin arrangement provided for Australia—besides the two flank contact pins according to FIGS. 2 and 3 of the drawing, projecting obliquely to one another, and as shown separately in FIG. 7—also includes a somewhat longer releasing (flat) pin. This releasing pin first mechanically frees the two pole contact bushes in the interior of the Australian plug outlet during the insertion process before an electrical connection is established.

Figure 11:
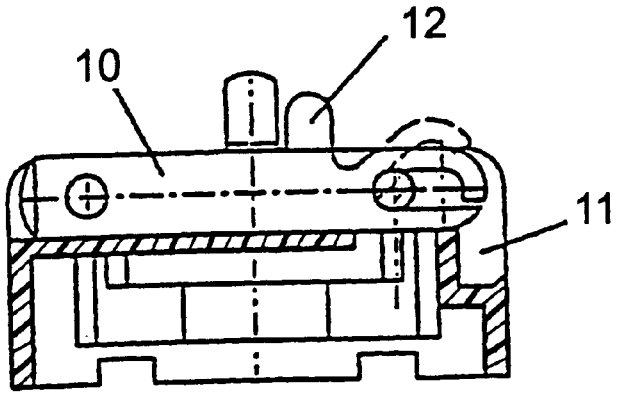
Figure 12:
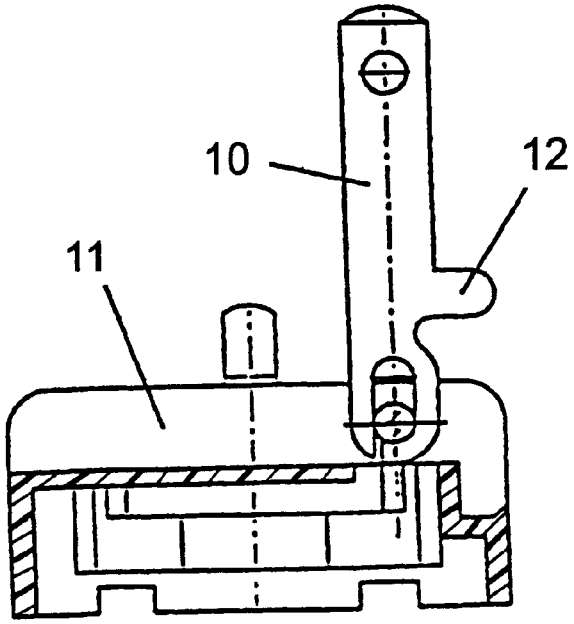
Figure 13:
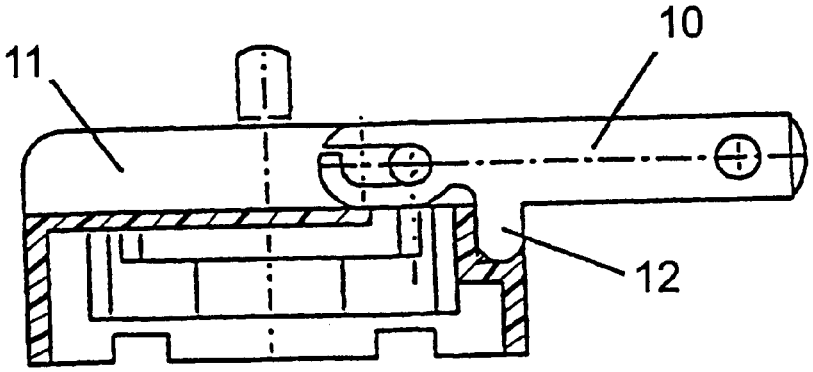
Figure 14:
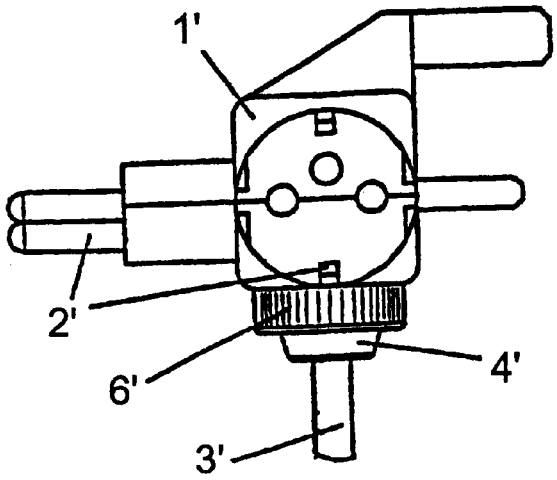
FIGS. 14 and 15 are side view of an another embodiment of a multiple plug according to the present invention having a three-pole configuration.
Figure 15:
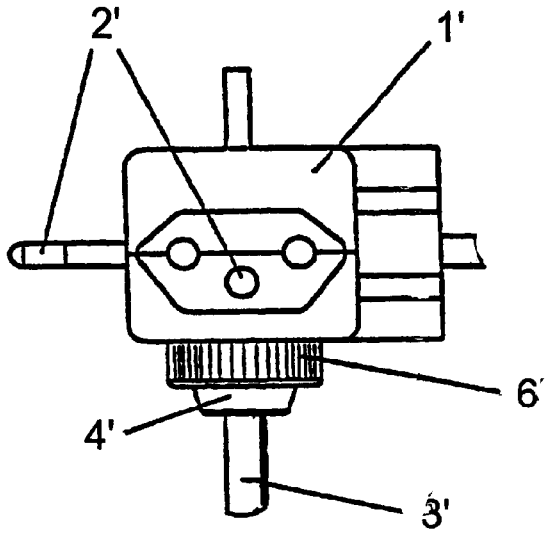
Figure 16:
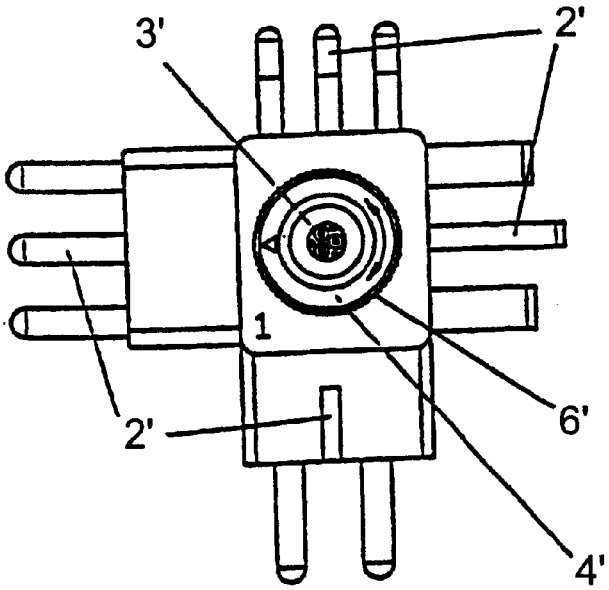
FIG. 16 is a plan view of the base surface of the multiple plug according to FIGS. 14 and 15.

In order to supplement the multiple plug of the present invention for this type of plug arrangement, it can be provided, as shown in FIGS. 8 to 10, with a flat pin 10 that is pivotable about an axis of rotation fixed to the plug housing. The flat pin 10 is arranged on the surface of the housing opposing the end of the housing in which the cable is introduced. The pivotal connection of the flat pin 10 to the housing 1 is arranged near the front side of the plug housing 1, within an oblong hole guide on the rearward end of the fiat pin 10. This arrangement allows the flat pin 10 to pivot between a rest position wherein the flat pin is arranged in a slot-form housing pocket 11 extending rearward to the outside through 180° into a contact position proper wherein the flat pin 10 is arranged above the two obliquely standing pole contact pins 2', as is represented successively in FIGS. 11 to 13. In the rest position, an onset cam 12 projects from the housing surface serving as handle. The cam 12 also serves to lock the flat pin relative to the housing when the flat pin is in the contact position. Specifically, the cam 12 is received in a front recess of the housing pocket 11 and in this manner fixes the flat pin 10 securely onto the plug housing 1. The flat pin 10 is made as a stamped part with an open guide shank as shown in FIG. 11 and can be later fitted onto the pivot pin provided on the housing.

Figure 17:
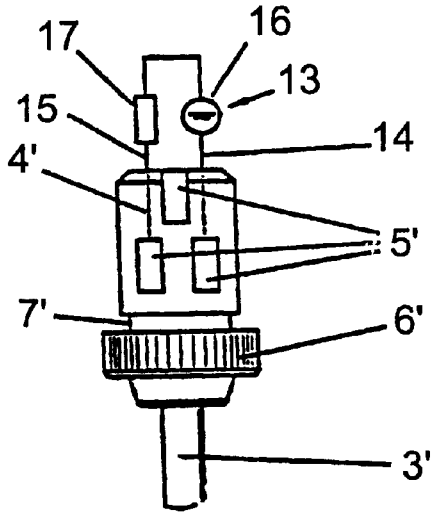
FIG. 17 is a side view of the contact sleeve of the multiple plug according to FIGS. 14 and 15 which includes an optical display device.

In FIGS. 14 to 19, a first embodiment of a three-pole protective contact multiple plug according to the present invention is shown. As is evident from FIGS. 14 and 15, the protective contact multiple plug carries on its side surfaces the plug pin arrangements of four different connecting systems, namely according to, with reference to FIGS. 16 and 19, the German standard system, on the left the Swiss standard system, above the Italian standard system, and on the right side the British standard system. In the interest of clarity in each case only the protective contact pins of the foreign plugs or the laterally lowered metal inlays on the German plug which contact the springy slide contacts on the sides of a protective German contact outlet, are provided with the reference number 2'. Moreover, for adjustably supporting the connecting cable 3' in the housing 1' of the multiple plug, a contact sleeve 4', separately shown in FIG. 17, is provided on the appropriate end of the connecting cable.

The contact sleeve 4' carries on its cylindrical outer surface the contact paths 5' which are connected with the line strands of the connecting cable 3'. In this case, the contact paths 5' are applied in two successive rows on the contact sleeve.

In a similar arrangement to the FIG. 1 embodiment, when the contact sleeve is inserted inside the recess in the base surface of the housing 1', the contact paths 5' can be brought into conductive contact with the corresponding mating contacts 8' on the connection end of the corresponding plug pins 2', or respectively on the corresponding metal inlays (protective contacts) according to the German standard, by manually adjusting the position of the contact sleeve relative to the housing. In this case, the mating contacts 8', which extend under spring tension from the ends of the plug pins or of the metal inlays in the direction of the inserted contact sleeve 4', are spaced in a corresponding manner to the spacing of the contact coatings 5' on the contact sleeve.

Similar again to the embodiment of FIG. 1, the contact sleeve includes a knurled flange 6' which can be used to manually adjust the position of the contact sleeve relative to the plug housing by hand in order to set the multiple plug to the plug pin arrangement required for a particular plug and outlet system.

In order to give the user an indication as to whether the chosen local plug outlet is capable of functioning at all, an optical display device 13 is provided as shown in FIG. 17, which is connected over feed lines 14, 15 with the corresponding contact coatings 5'. In the illustrated embodiment, the display device comprises a glow lamp 16 which is connected in series with a protective resistor 17 on the contact coatings 5'. When the multiple plug is capable of functioning in a given outlet, the light generated by the display device 13 in the case of function-capable plug outlet can be seen the from outside either through a colored viewing window or through a fully transparent plug housing. It is also possible to make the contact sleeve itself, at least partially, out of a transparent material and to arrange the display device 13 inside the contact sleeve. If necessary, the surface of the plug housing opposite the base surface where the connection cable is received can have a viewing window and/or, at least partially, consist of a transparent material. In any case, the operator immediately via the lighting-up of the display 13 that the contact sleeve 4' was turned into the correct position and that the plug outlet uses the desired voltage, so that an electric apparatus can be put into operation.

For the rotatable support of the contact sleeve 4', the housing engages by means of a guide lip into an annular groove 7 provided between the sleeve body and the knurled flange 6'. In the area of the knurled flange, a retaining mechanism 9' for the connecting cable 3' and a locking mechanism (not shown), with which the contact sleeve 4' can be set exactly on the desired plug pin arrangement are provided.

FIG. 20 is a partially sectioned side view of a further embodiment a contact sleeve 18. In order to achieve a simple and low-friction support of the contact sleeve 18 within the multiple plug, 1, 1', locking elements 20 are provided in a outer wall 19 of the contact sleeve 18. These are an integral component of the contact sleeve 18 and are pivotable about a joint 21. The locking element 20 has a lug 22 which bears on an underside of the guide web bounding the opening to the recess in the plug housing 1, 1'. Thereby, an easy turning of the contact sleeve 18 is made possible, in which process simultaneously a pulling-out of the contact sleeve 18 from the housing is precluded.

In order to ensure effective strain relief, a radial bore for the reception of a screw which exerts a force on the retaining mechanism 9' is provided in the knurled flange 6'.

Figure 21:
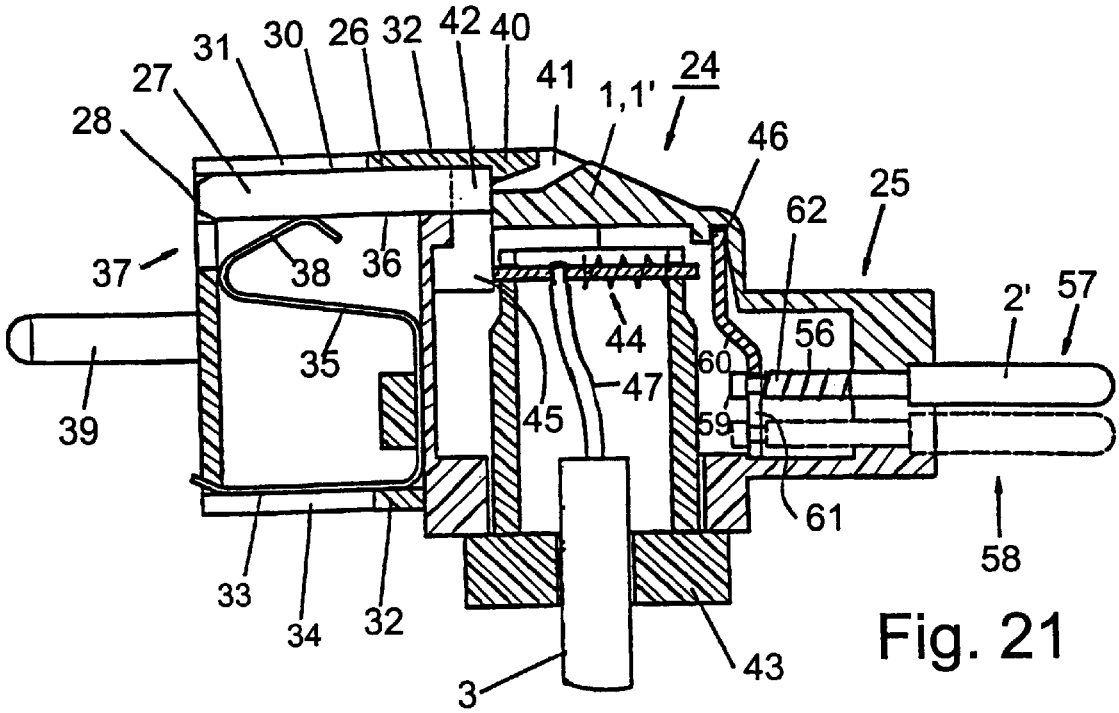
FIG. 21 is a sectioned side view of another embodiment of a multiple plug according to the invention.

FIG. 21 illustrates a second embodiment of a three-pole protective contact multiple plug 24, in which like elements are designated the same reference numbers used with the earlier described embodiments. The multiple plug 24 includes a plug pin arrangement 25 having at least one slidable protective contact pin 2', which allows the plug pin arrangement 25 to be used in both connecting systems according to the Italian standard and connecting systems according to the Swiss standard.

Further, the multiple plug 24 is detachably connected with an adapter 26. The adapter 26 is preferably arranged on a side surface of the multiple plug 24, which has a plug pin arrangement according to the British standard. The British standard arrangment is distinguished by a projecting protective contact bow 27, which together with main contacts (not shown) forms essentially an equilateral triangle. The protective contact bow 27 is completely received by a receptacle 28 inside the adapter 26. An outside-lying surface area of the contact bow 27 is accessible through a recess 31 within the wall 32 of the adapter 26 as a first protective contact 30 according to the German/Austrian standard.

A second protective contact 33 is provided lying diagonally opposite the first protective contact 30, which is likewise accessible over a recess 34 within the outer wall 32 of the adapter 26. The second protective contact 33 is part of a sliding contact 35 which bears under spring tension preferably on an underside 36 of the protective contact bow 27. For adapting to further configurations, especially according to the French/Belgian standard, a further receptacle 37 is provided which extends parallel or substantially parallel to, and underneath, the protective bow 27. This serves for the reception of a plug outlet side protective contact pin which is received by the receptacle 37 and is conductively connected with the underside 36 of the contact bow when the multiple plug is plugged in. In addition, the plug outlet side protective contact pin is pressed over a bow-shaped section 38 of the slide contact 35 against the underside 36 of the protective contact bow 27 in order to establish an electrically conducting contact.

This arrangement utilizes the fact that the arrangement of the main contacts 39 according to the German/Austrian standard and the French/Belgian standard essentially coincide. The outer configuration of the adapter 26 essentially resembles the shape of a standardized protective contact plug.

For fastening the adapter 26 to the multiple plug 24, the multiple plug has a locking element 40 which is lockably anchored in a recess 41 in the outer housing zone of the multiple plug 24. In the illustrated embodiment, a lug of the locking element 40 engages a projecting edge 42 of the essentially L-shaped protective contact bow 27, so that the latter assumes a double function. The springy, bow-shaped section 35, 38 is firmly joined with the adapter 26.

In this embodiment, the contact sleeve 43 has essentially the same structure as the previously-described contact sleeves 4, 4'. However, in contrast to the previously described embodiments, the contact sleeve 43 has a spring loaded protective conductor contact 44 and the mating contacts 45, 46 of the protective contact pins 27, 2' are rigidly constructed. The protective conductor contact 44 is firmly joined, preferably over a soldered connection, with the protective conductor 47 of the connecting cable 3.

Figure 22:
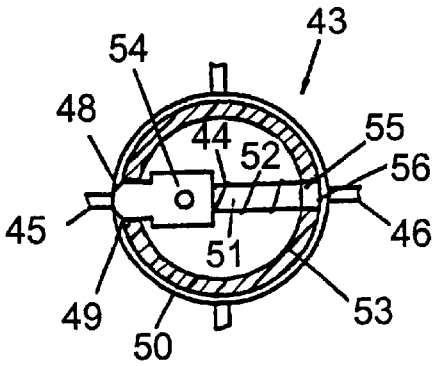
FIG. 22 is a plan view of a further embedment of a contact sleeve.

FIG. 22 provides a plan view of the contact sleeve 43. As shown, the protective conductor contact 44 is constructed as a contact pin, with a contact surface 48 which projects through an opening 49 in a wall 50 of the contact sleeve 43 and can be brought into conductive connection with the counter contacts 45, 46. In order to produce the necessary contact pressure, a spiral spring 52 is arranged coaxially to a section 51 of the contact pin 44. The spiral spring 52 extends between an inner wall 53 of the sleeve 43 and a soldering connection vane 54 of the protective conductor contact 44. An element 55 lying opposite the contact surface 48 is supported in a further opening 56 of the wall 50 of the contact sleeve 43.

As already mentioned above, the multiple plug 24 has a pin arrangement 25 which is changeable by sliding a plug pin out of a configuration according to the Italian standard, into a configuration according to the Swiss standard. Specifically, the protective contact 2' is slidable out of a first position 57, which preferably corresponds to a plug configuration according to the Italian standard, into a second position 58, which preferably corresponds to a plug configuration according to Swiss standard as shown in FIG. 21.

The protective contact 2' is slidable counter to the force of a spring element 56, in order to make possible a shifting out of the first position 57 into the second position 58.

Figure 23:
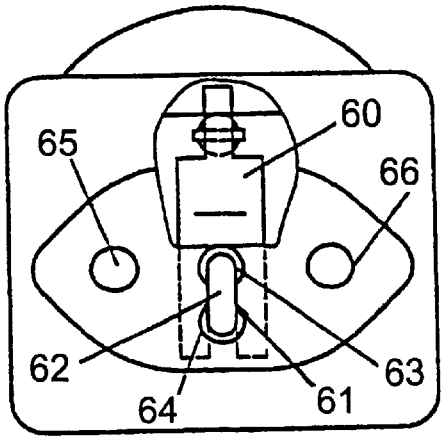
FIG. 23 is a front plan view of a group of pin arrangement having a slidable plug pin.

On the interior side of the plug the protective contact 2' is conductively connected, by means of an anchor-shaped end 59, with a contact bar 60, which both forms the counter contact 46 and comprises a guide 61 for the anchor-shaped end zone 59. The contact bar 60 is firmly joined with the housing of the multiple plug 24, so that thereby also the protective contact 2' is arrestable. The protective contact 2' has a substantially cylindrical construction and has a tapering 62 in its end zone 59 which is slidable lengthwise in the guide 61. As represented in FIG. 23, the guide 61 is constructed as an oblong hole 62, with blind hole-type receptacles arranged in the end portions of the oblong hole 62. The stamp-form end zone 59 of the protective contact 2' is receivable in these receptacles. In particular, the receptacle 63 is allocated to the position 57 and the receptacle 64 to the position 58. The spring element 56 ensures that the protective contact 2' is held in the particular position 57, 58 and that there is established a sufficient electrical contact with the contact bar 60.

As is further evident from FIG. 23, main contacts 65, 66 are arranged in a first plane and the protective contact 2' is slidable in a second plane which runs perpendicular to the plane defined by the main contacts 65, 66. In the position 57, the protective contact 2' is located in the plane defined by the main contacts 65, 66 and in the position 58 the protective contact 2' defines a triangle with the main contacts 65, 66.

Figure 24:
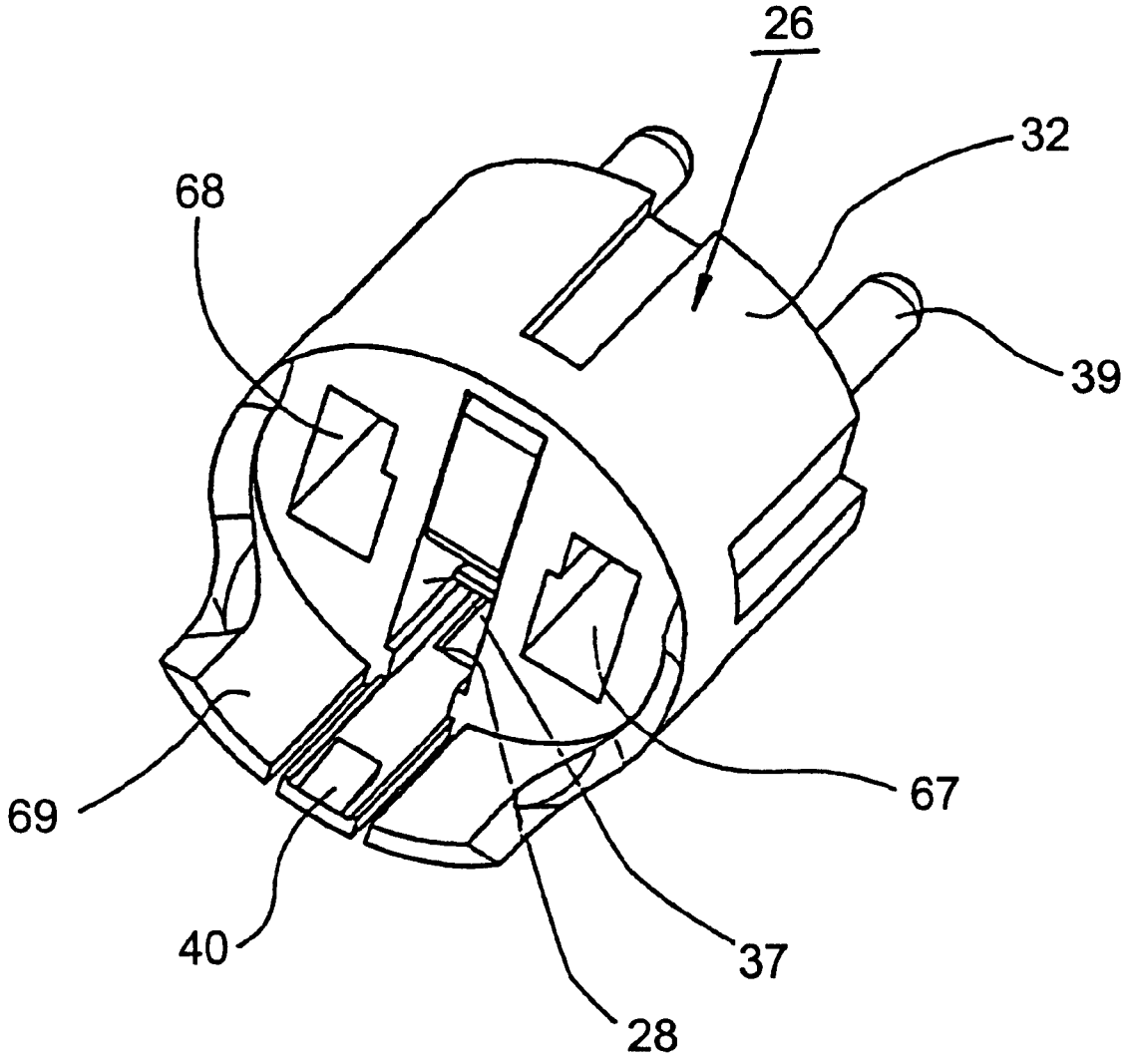
FIG. 24 is a perspective view of an adapter for modifying a configuration of the multiple plug according to the British standard for the configuration according to the German/Austrian standard and the French/Belgian standard.

FIG. 24 provides a three-dimensional representation of the adapter 26. On the plug outlet side, the adapter essentially has the form of a commercially usual protective contact plug, as prescribed according to the German/Austrian standard. On the multiple plug side, the receptacles 28 and 37 are formed, which are designed with the first receptacle for the reception of the protective contact bow 27 according to the British standard and with the second receptacle 37 for the reception of the plug outlet side protective contact pin according to the French/Belgian standard.

Further receptacles 67, 68 are provided, into which the main plug pins mounted on the multiple plug 24 are introduced, in order to established a conductive connection with the main contacts 39 of the adapter.

Starting from the essentially cylindrical wall 32 there extends at least in areas, a wall zone 69 which has the same lengthwise dimension as the locking element 40. The locking element 40 is preferably constructed parallel or essentially parallel to the upper surface 30 of the protective contact bow 27 and locks with this.

Figure 25:
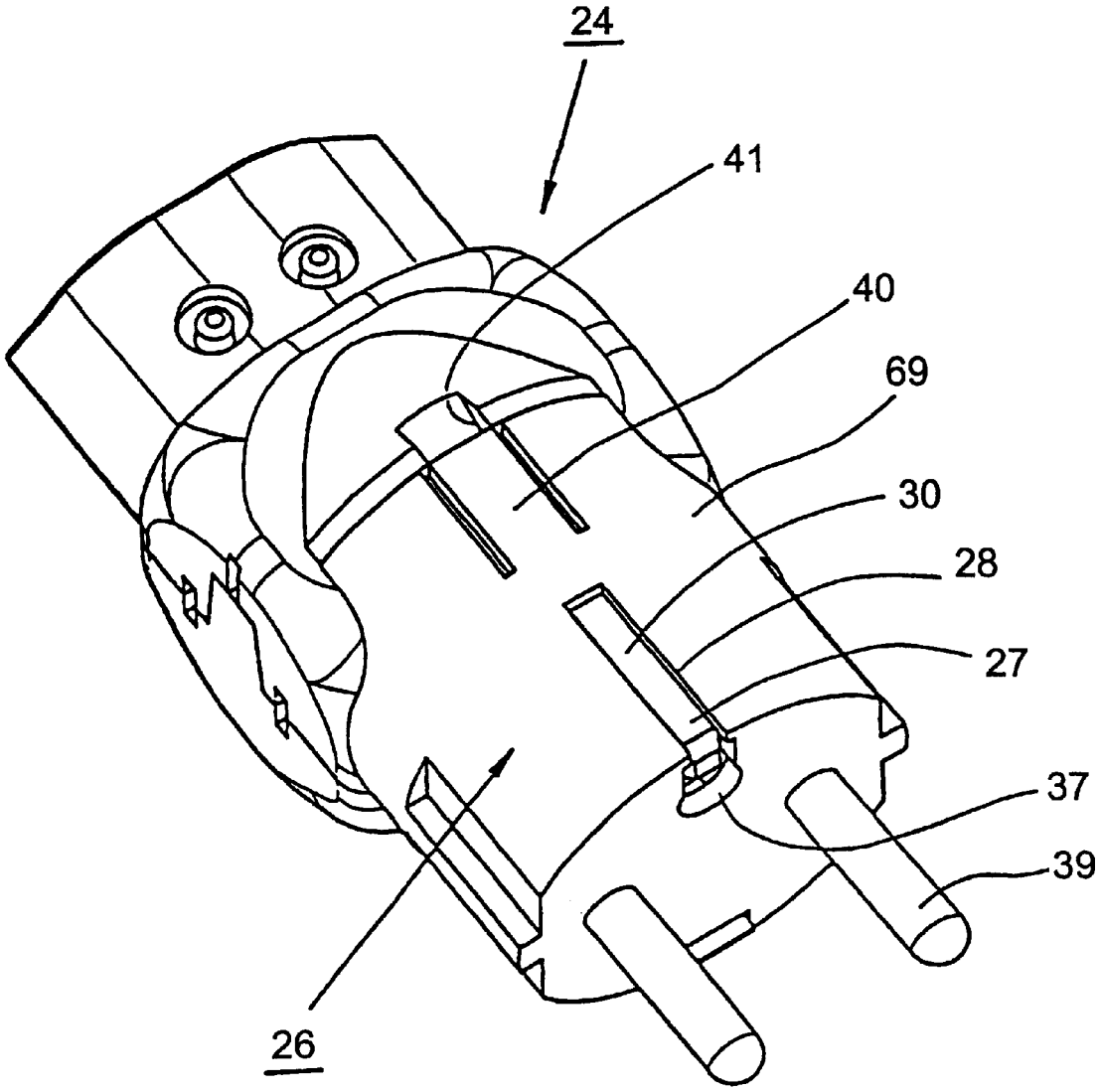
FIG. 25 is a perspective view of the adapter of FIG. 24 as installed on a multiple plug according to the present invention.

FIG. 25 provides a perspective depiction of the multiple plug 24 with adapter 26 in the assembled state. The locking element 40 is easily accessible over the recess 41 and can be released without the aid of a tool.

Figure 26:
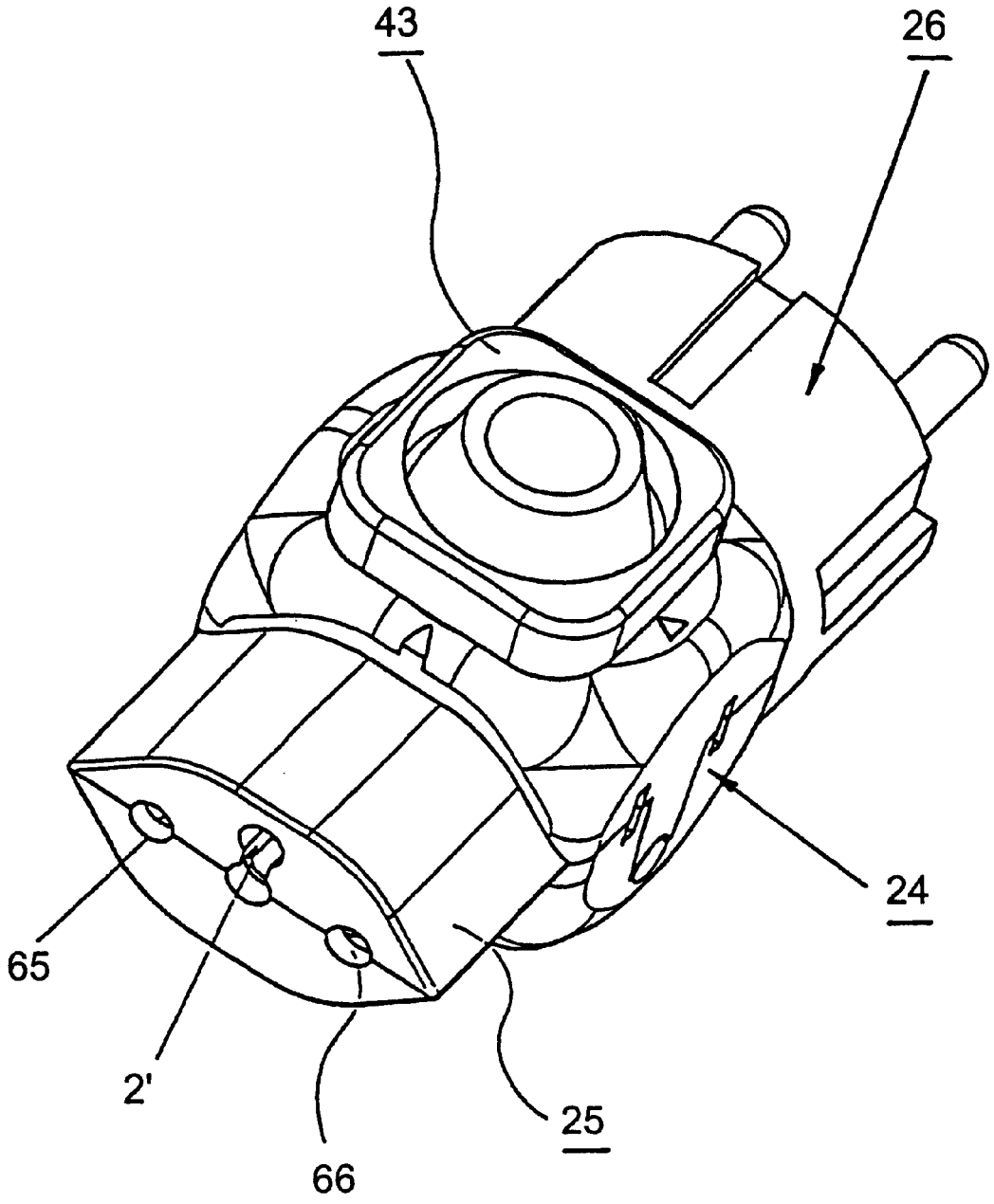
FIG. 26 is another perspective view of the adapter of FIG. 24 as installed on a multiple plug according to the present invention.

FIG. 26 provides a plan view of the multiple plug 24 with adapter 26 in perspective, which shows in particular the plug configuration 25 with slidable protective contact 2'.

In summary, the present invention provides a multiple plug which allows the connection of electrical devices to internationally differing connection systems. The multiple plug is firmly connected with the connecting line of the electrical with via a contact carrier rotatably supported inside a housing of the multiple plug. Thereby, the multiple plug cannot be removed and is a constant companion of the electric device. Through the contact carriers 4, 4', 43, the electric device can be conductively joined as desired with the various plug pins 2, 2' arrangements provided on the multiple plug.

According to a further aspect of the invention, a slidable contact, particularly a protective contact 2', can be provided which allows a plug pin arrangement to be fitted both to the Swiss and also to the Italian standard.

A further object of the invention with inventive character is an adapter 26 which can be connected with the multiple plug. The adapter makes the multiple plug of the present invention useable with two more standardized plugging systems. In the illustrated embodiment, the multiple plug 1, 1', 24 has four different pin arrangements, which by reason of the slidable protective contact and the adapter 26 can provide seven different international standardized plug pin arrangements.

What is claimed is:

1. A multiple plug device for selectively connecting an electrical device to one of a plurality different standardized electrical connection system outlets, comprising:

a power cable having a plurality of electrical conductors contained therein; and a multiple plug securely arranged on a connection end of the power cable, the multiple plug comprising a plug housing having a recess formed therein and a plurality of different plug pin arrangements protruding from an exterior surface thereof and a contact sleeve rotatably supported within the recess in the plug housing, the contact sleeve supporting a plurality of sleeve electrical contacts, the electrical conductors contained in the power cable being firmly joined to the sleeve electrical contacts, each respective plug pin arrangement comprising a plurality of plug pins each of which has an associated plug pin contact that extends into the recess in the plug housing such that by selective rotation of the contact sleeve in the recess relative to the plug housing the sleeve electrical contacts can be brought into engagement with the plug pin contacts associated with any one of the plug pin arrangements, and one of said plug pin arrangements including an unlocking pin which is supported on said plug housing for pivotal movement between a rest position in which the unlocking pin is arranged in a slot in the plug housing and an extended position in which the unlocking pin is arranged for insertion into an electrical connection system outlet.

2. The multiple plug according to claim 1 wherein the plug pin contacts are resilient.

3. The multiple plug according to claim 1 wherein the contact sleeve includes two sleeve electrical contacts which are arranged in parallel relation to each other.

4. The multiple plug according to claim 1 wherein the contact sleeve includes a knurled flange which abuts against a base surface of the plug housing and which facilitates manual adjustment of the position ofthe contact sleeve relative to the plug housing.

5. The multiple plug according to claim 1 wherein a plurality of strain-relieving barbs are arranged on an interior of the contact sleeve, the barbs extending at an angle towards the connection end of the power cable and engaging an outer surface of the power cable.

6. The multiple plug according to claim 1 wherein the plug housing includes a guide ridge which engages an annular groove on the contact sleeve.

7. The multiple plug according to claim 1 wherein the unlocking pin includes a lateral lug which locks the unlocking pin in the extended position and projects as a handle when the unlocking pin is in the rest position.

8. The multiple plug according to claim 1 wherein the electrical conductors of the power cable are soldered to the sleeve electrical contacts.

* * * * *